United States Patent [19]

Taylor

[11] Patent Number: 4,601,320

[45] Date of Patent: Jul. 22, 1986

[54] INDUSTRIAL DOOR

[76] Inventor: Douglas Taylor, 49 Belcourt Ave., Barrie, Ontario, Canada, L4M 4S5

[21] Appl. No.: 578,768

[22] Filed: Feb. 9, 1984

[51] Int. Cl.[4] ..... E06B 9/17

[52] U.S. Cl. ..... 160/271; 160/133; 160/242; 98/50

[58] Field of Search ..... 160/368 R, 369, 181, 160/182, 194, 195, 203, 209, 212, 238, 239, 266, 268, 270, 271, 273 R, 272, 242; 98/50; 405/150

[56] References Cited

U.S. PATENT DOCUMENTS

| | | | |
|---|---|---|---|
| 1,243,377 | 10/1917 | Allison et al. | 98/50 |
| 2,350,288 | 5/1944 | Michelman | 160/271 X |
| 2,738,179 | 3/1956 | Joy | 98/50 |
| 3,238,995 | 3/1966 | Bonzer | 160/212 |
| 3,430,677 | 3/1969 | Pierce | 160/271 X |
| 3,797,553 | 3/1974 | Elliott | 160/273 X |
| 4,016,920 | 4/1977 | Shepard | 160/194 X |
| 4,126,174 | 11/1978 | Moriarty et al. | 160/266 |
| 4,219,067 | 8/1980 | Hurst | 160/201 X |
| 4,220,189 | 9/1980 | Marquez | 160/269 X |
| 4,388,779 | 6/1983 | Peterson | 98/50 X |
| 4,478,268 | 10/1984 | Palmer | 160/272 X |

*Primary Examiner*—Ramon S. Britts
*Assistant Examiner*—David M. Purol
*Attorney, Agent, or Firm*—Wegner & Bretschneider

[57] ABSTRACT

A pressure differential compensating door includes a curtain for closing a doorway having a first upper end, a second lower end and side edges and a curtain winding mechanism having the first end of the curtain attached thereto for raising and lowering the curtain. In addition there is a pair of spaced apart guide channels in which side edge sections of the curtain are movable. These side edge sections are sealingly engagable with the channels. A door pressure releasing mechanism connects the door in sealing engagement with a door surrounding structure. The releasing mechanism is operable to move the door away from the door surrounding structure prior to the curtain being raised and to release any pressure differential existing on opposing sides of the door. Special friction reducing members are fixed to both of the side edge sections and extend therealong to reduce the amount of friction between these sections and their guide channels.

21 Claims, 8 Drawing Figures

INDUSTRIAL DOOR

BACKGROUND OF THE INVENTION

The present invention relates to doors and more particularly to overhead doors which are employed in industrial application including mining application.

It is known to construct an industrial door structure which includes a curtain for closing the doorway and a curtain winding mechanism for raising and lowering the curtain. Such a door structure is disclosed in South African Pat. No. 80/0440 wherein the inventor is Glenn R. Palmer. This known door is advantageous in that damage is minimal if the door is struck by a vehicle which must pass through the door on a regular basis. The curtain is made of a rubber composition and it is thicker along its side edges so that it is normally retained at the side edges in guide channels. In many mining applications, there is often a pressure differential on opposing sides of the door and the edges of the curtain are designed to sealingly engage the guide channels in order to maintain the pressure differential.

In applications where doors, including flexible curtain doors, have to be maintained closed to maintain a predetermined pressure within an environment, experience has shown that differential pressure building up on opposing sides of the door can make it extremely difficult if not impossible, to open the door.

It is an object of the present invention to provide a pressure-differential compensating door which can be readily opened when different pressures exist on opposing sides of the door.

It is a further object of the present invention to provide a pressure-differential compensating door which is also a damage-minimizing door which can be readily repaired and maintained subsequent to an impact with vehicular traffic.

SUMMARY OF THE INVENTION

According to one aspect of the present invention, a pressure differential compensating door comprises a curtain for closing a doorway having a first upper end, a second lower end, and side edges and a curtain winding mechanism having the first end of the curtain attached thereto for raising and lowering the curtain. The door includes a pair of spaced apart guide channels in which side edge sections of the curtain are movable. These side edge sections are adapted to sealingly engage the channels. A door pressure releasing mechanism is adapted to connect the door in sealing engagement with a door surrounding structure. The door pressure releasing mechanism is operable to move the door away from the door surrounding structure prior to the curtain being raised and to release any pressure differential existing on opposing sides of the door. This has the advantage that once the pressure is equalized the curtain may be readily raised without the side edges of the curtain jamming in the guide channels.

It should be understood that the expression "door surrounding structure" referred to herein and in the appended claims means a frame or that portion of a wall to which the door is mounted.

According to another aspect of the present invention, a roll-up door comprises a flexible curtain for closing a doorway having a first end, a second lower end, and side edges and a curtain winding mechanism having the first end of the curtain attached thereto for raising and lowering the curtain. This door includes a pair of spaced-apart guide channel means with side edge sections of the curtain being movable in the guide channel means and engagable therewith. Friction reducing members are affixed to both of the side edge sections and extend therealong to reduce the amount of friction between the side edge sections and their respective guide channels.

In one preferred embodiment, the curtain is made of rubber or synthetic rubber and the friction reducing members comprise plastic strips. The plastic strips are made of ultrahigh molecular weight plastic and are affixed to both the front and the back of each side edge section.

Further features and advantages will be apparent from the following detailed description given by way of example, when read in conjunction with the accompanying drawings.

DETAILED DESCRIPTION OF PREFERRED EMBODIMENT

Figure 2:
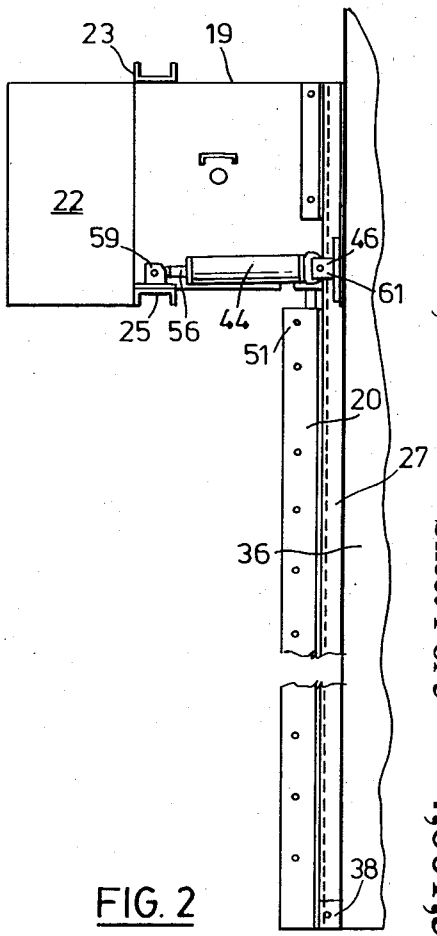
FIG. 2 is a side elevational view showing the door of FIG. 1 secured in sealing engagement to the door surrounding structure.

Referring to FIGS. 1 to 4 there is shown a pressure-differential compensating door 10 which is also a damage minimizing door suitable for use in mining application. The door 10 includes a flexible curtain 12 having a first upper end 14 attached to a curtain winding mechanism which includes a spring barrel 16. The spring barrel 16 is a well known feature of overhead doors and further description of this barrel and the mounting therefor is deemed to be unnecessary. A shaft 17 projects from each end of the barrel and is mounted in a vertical support plate 19.

An idler barrel 18 is located below the spring barrel and is attached to the support plates or end brackets 19 by inserting a shaft 21 on either end of the idler barrel into holes provided near the base of each support plate 19. The curtain winding mechanism includes a door lift power unit 22 which is attached to the upper section of the door 10 to provide a lift force required to lift the curtain under normal operating conditions. The curtain will lower to the closed position under its own weight. The preferred power unit 22 is electrical and is an integrated completely enclosed prime mover consisting of a worm gear box, control section and electric motor (not shown). The control section can contain a solenoid operated brake, rotary limit switches and a mechanical interlock to prevent electrical operation when a manual chain hoist is engaged. Additional controls for a safety edge, radio control, time delay, etc. may be incorporated into the control section if desired. Such electrical power units for the operation of overhead doors are well known and the power unit per se does not form a novel aspect of the present invention.

The upper portion of the door structure further includes channel members 23 and 25 that extend between and connect the side support plates 19. The channel member 25 is longer than the upper member 23 to permit hydraulic jacks to be connected thereto as explained hereinafter. The back edge of each support plate 19 is rigidly connected to a respective vertical channel member 27 which can be seen in cross section FIGS. 5 and 6. Each of the two channel members 27 extends from the floor to the very top of the door structure. Extending between and connecting the channel members 27 are horizontal channel members 29 and 31. The bottom end of each channel member 27 is pivotally secured by an anchor hinge 38 to the wall or door surrounding structure 36. The preferred door surrounding structure is one made of steel and it can for example be made from wide flanged beams. A steel surrounding structure permits easy attachment of such parts of the door structure as the anchor hinges 38 and the hydraulic cylinders 44 described hereinafter.

Turning now to the construction of the flexible curtain 12, there is provided at its lower end 24 a rigid bar 26 attached by means of bolts 33. The lower end 24 is clamped between a structural angle 35 and a flat elongate plate 37 which together make up the bar 26. The purpose of the bar 26 is to resist the bending action of the curtain and to maintain the curtain parallel with the threshold of the door. There can also be clamped between the angle 35 and the plate 37 a section of a flexible sealing strip 28. This strip 28 which can be made of rubber provides the means to seal the curtain with the threshold when the curtain is lowered to its closed position. If desired the strip 28 can contain electrical wiring 39, forming part of a known electrically actuated safety system which provides for emergency stoppage of the downward action of the door should an obstruction be present in the opening. Such an emergency safety system is well known in the overhead door art and further description of this system in the present application is deemed unnecessary. The preferred means of attachment for the lower end 24 of the curtain is to cut V-shaped notches in the bottom edge to accomodate the bolts 33. In this way the curtain is less likely to be damaged under impact because the bar 26 can be pulled from the bottom edge of the curtain without tearing or damaging the latter.

Figure 5:
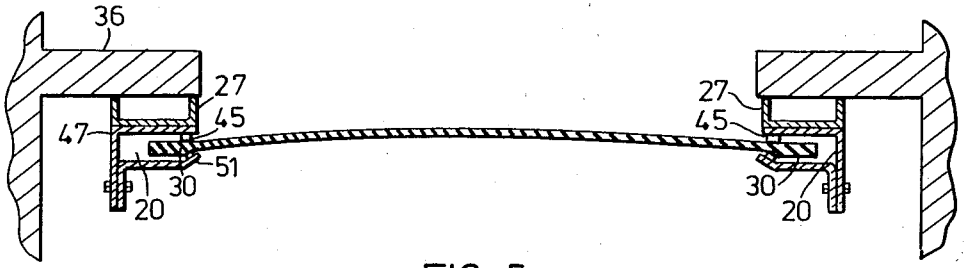
FIG. 5 is a sectional view taken at line V—V of FIG. 1.
Figure 3:
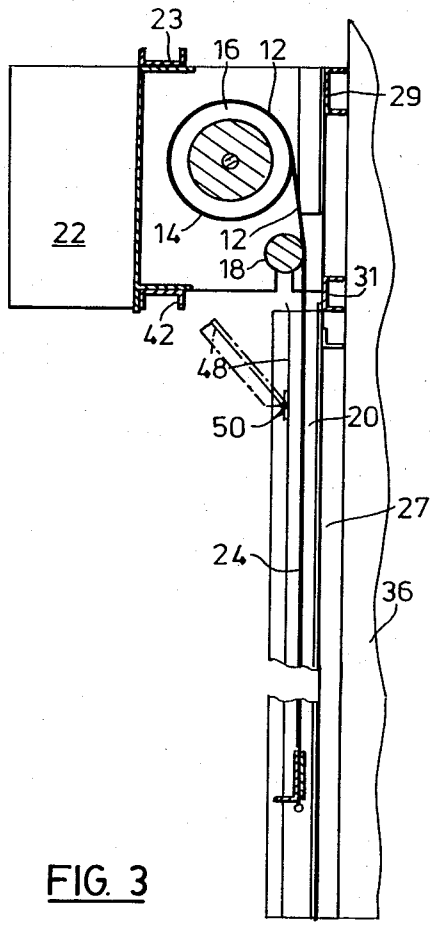
FIG. 3 is a sectional elevation of a door taken along the line III—III of FIG. 1.
Figure 7:
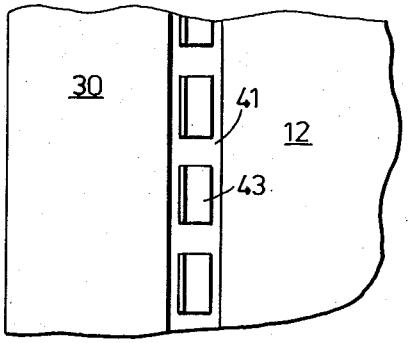
FIG. 7 is a front detail of the side edge section of the curtain.
Figure 8:
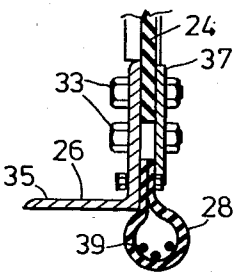
FIG. 8 is a detail view illustrationg the bar on the bottom of the curtain.
Figure 6:
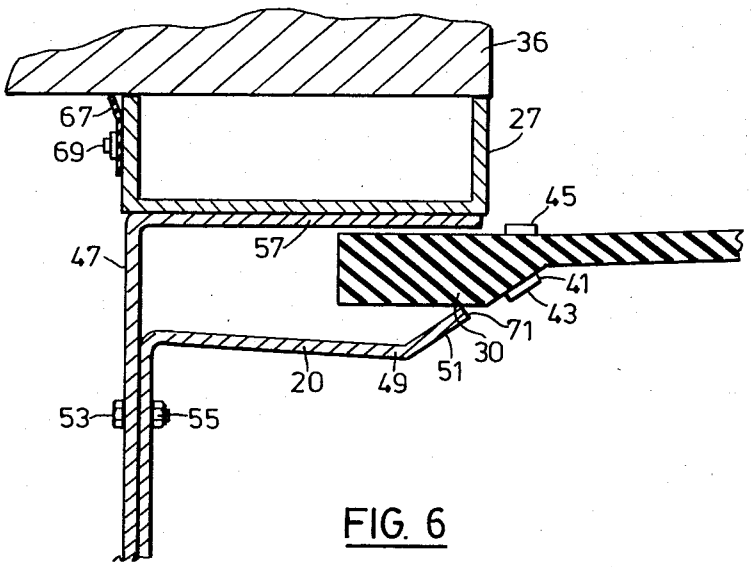
FIG. 6 is a sectional view taken at line VI—VI of FIG. 1 showing one side edge of the curtain and its respective guide channel and illustrating how the side edge section can be pulled from the channel under impact.

The construction of the vertical side edges of the curtain can be seen from FIGS. 5 to 7. The side edges 30 are thicker than the remaining portion of the curtain 12 and are movable in the aforemention guide channels 20. In the preferred embodiment shown the side edges are more than twice as thick as the remaining portion of the curtain and are formed by adhering a second layer of rubber to each side edge. The inner side of the additional layer of rubber is bevelled at 41 and along the sloping surface is arranged friction reducing means in the form of short plastic strips 43. Further friction reducing means are provided on the opposite side of the curtain and these means are made of long plastic strips 45. The plastic strips 43 and 45 are provided to reduce the amount of friction between the side edge sections 30 and their respective guide channels 20. The preferred plastic strips are constructed with ultrahigh molecular weight plastic which has a low coefficient of friction. It is preferable for the two strips 45 located on the back surface of the curtain to be continuous strips in order that a seal will be provided between the side edge sections of the curtain and their guide channels. The strips 45 can be continuous without creating problems when the curtain is wound up because these strips are located on the radially outer side of the rolled up curtain. It is preferable that the strips 43 be short and spaced apart along the bevelled shoulder 41 as shown in FIG. 7 in order that these strips will not be bent unduly or separated from the rubber curtain as the result of numerous operations of the door.

Only recently has it become possible to satisfactorily bond plastic strips of the type illustrated in FIGS. 5 to 7 to rubber. The process that is used is a molecular process. In the actual construction of applicant's door, the plastic strips 43 and 45 are purchased with a thin layer of rubber already bonded to one surface by this molecular process. Strips of this nature are sold under the trade name RB85 by Robco Incorporated. When these particular strips are being used, it then becomes necessary only to bond rubber to rubber, a well known operation.

The construction of the guide channels 20 can be seen readily from FIGS. 5 and 6. In particular there is a large, elongate structural angle 47 and a smaller structural angle 49. Both the outer angles 47 extend from the floor of the door opening to the location 51 indicated in FIG. 2. The inner angle 49 extends from the floor of the door opening to a hinge member 50. One leg of the angle 49 is bent inwards towards the corresponding leg of the angle 47 to form a sloping shoulder 51 which is engaged by the plastic strips 43 of the curtain under normal conditions. Preferably the angles 47 and 49 are constructed from ordinary mild steel of approximately $\frac{1}{4}$ inch thickness. Such steel is flexible enough not to damage the rubber curtain if it is pulled from the guide channel as shown in FIG. 6. It will be appreciated that under vehicular impact, the side edge sections of the curtain can be pulled from the guide channels because the bent legs of the angle 49 will flex sufficiently to enable the side edge sections to come out. The angles 47 and 49 are bolted to one another by means of bolts 53 and nuts 55. The leg 57 of the angle 47 can be rigidly attached (such as by welding) to the adjacent channel member 27.

Connected to each of the aforementioned hinges 50 is a relatively short angle member 48 forming an upper portion of the guide channel. The plate 48 can be pivoted about its hinge connection as illustrated in dashed lines in FIG. 3 to facilitate insertion of its respective side edge section into the guide channel. As illustrated, each member 48 can be held inplace by two bolts. If desired each plate 48 can be spring biased by a coil spring located at the hinge 50 towards the position shown in solid lines in FIG. 3.

Figure 1:
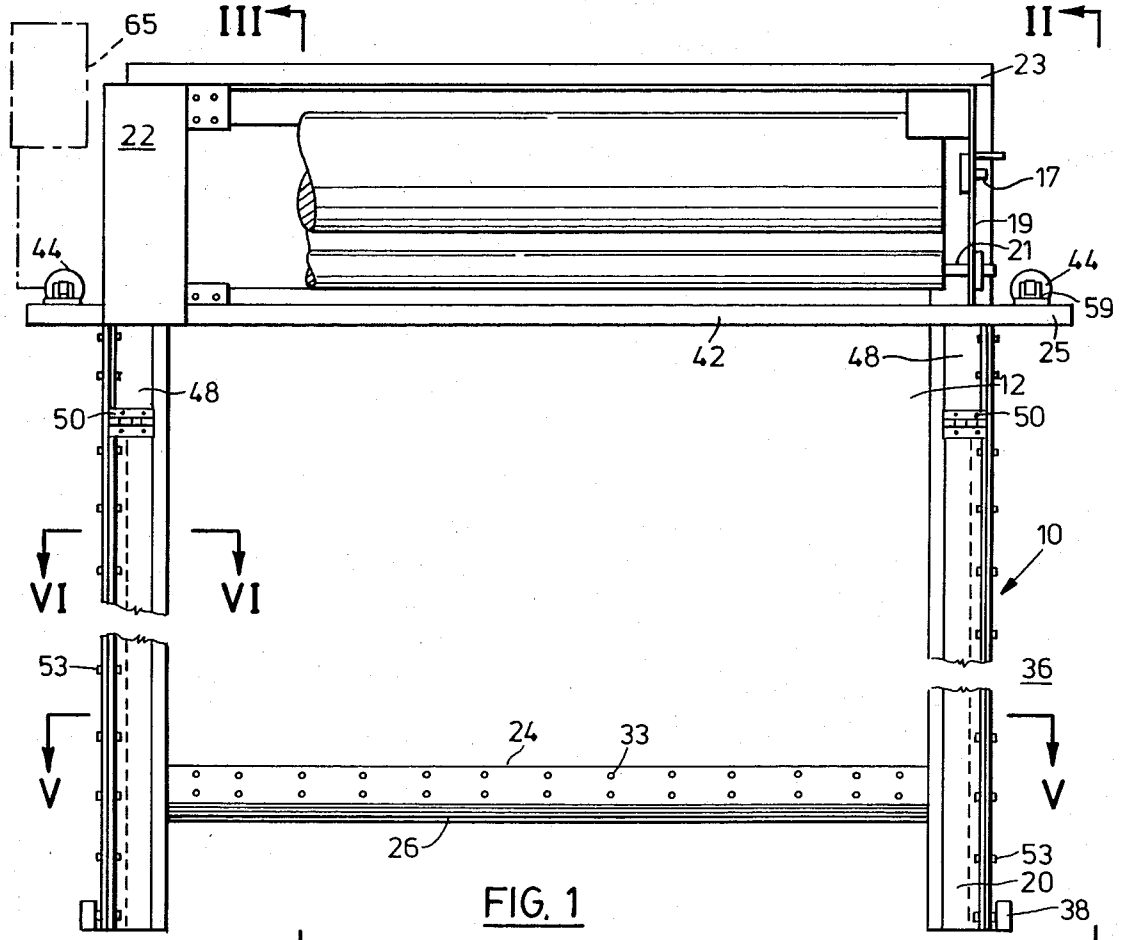
FIG. 1 is a front elevational view of a preferred embodiment of the present invention.

It should be understood that the bar 26 shown in FIG. 1 does not extend into the guide channels 20. This arrangement is necessary in order for the damage to the door structure to be minimal if the door is struck by a vehicle.

In mining applications for the present door structure, the door operates to seal one section of a mine off from another section of a mine. In certain instances a considerable pressure differential buildup may occur on opposing sides of the door (in the order of 8–10 tons) resulting in the curtain bending as shown in FIG. 5 and making it difficult to raise and lower the door even with the use of the plastic strips 43 and 45. To overcome this problem door pressure releasing means which connect the door and sealing engagement with the door surrounding structure are employed. These releasing means are operable to move the door 10 away from the door surrounding structure 36 prior to the curtain being raised and to release any pressure differential existing on opposing sides of the door. The preferred door pressure releasing means includes the aforementioned hydraulic cylinders 44. One of these cylinders is located on each side of the door near the top. A hydraulic piston member 56 is slidable in each cylinder and is connected to lugs 59 that extend upwardly from the channel member 25. Each hydraulic cylinder is pivotally connected by means of lugs 61 to the door surrounding structure 36. The hydraulic cylinders are connected to a hydraulic power unit 65 in a well known manner. The hydraulic power unit is of standard construction and a detailed description of this unit is deemed unnecessary. In one preferred embodiment of the present door structure each hydraulic cylinder has a stroke of approximately nine inches.

Figure 4:
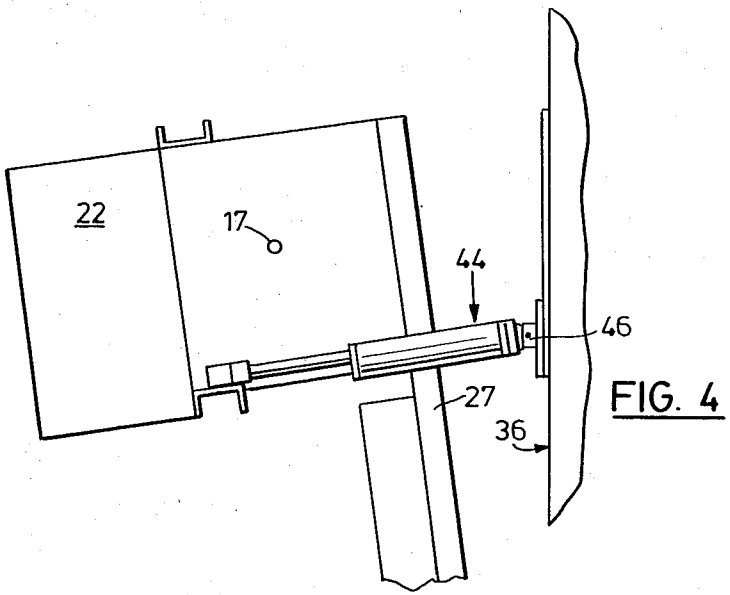
FIG. 4 is a side elevation of the upper portion only of the door structure wherein the door has been moved away from the door surrounding structure.

It will now be understood that in order to overcome a pressure differential buildup, the hydraulic cylinders 44 can be actuated to push the door structure to the position shown in FIG. 4. The door structure pivots about the hinge anchors located at 38. As a result pressure equalizes on opposing sides of the door making it relatively easy to move the side edges 30 of the curtain in the guide channels. After the curtain is raised, the hydraulic cylinders 44 are returned to the position shown in FIG. 2 bringing the door back into engagement with the door surrounding structure.

It will be obvious to those skilled in the art that there are alternatives to the hydraulic cylinder shown for providing door pressure releasing means. For example, these cylinders could be replaced by pneumatic cylinders. Pneumatic cylinders may however be less reliable than hydraulic cylinders. Alternatively a rack and pinion mechanism could be employed to move the door structure away from the door surrounding structure. The pinion could then be operated by an electric motor.

In order to provide an air tight seal between the vertical channel members 27 and the door surrounding structure 36, flexible flaps 67 can be provided. Each flap is attached to the outer flange of the channel member 27 by means of bolts or other suitable connectors 69.

The gap between the end 71 of the angle member 49 and the leg 57 is sized so that the curtain 12 can be pulled under impact from the guide channel without damage to the curtain. In one preferred embodiment wherein the curtain 12 is $\frac{1}{4}$ inch thick (except for the side edge section 30) the gap formed by each guide channel measures approximately $\frac{1}{2}$ inch. It will be appreciated that the side edge section 30 in this preferred embodiment has a thickness which exceeds $\frac{1}{2}$ inch so that under normal conditions the side edge section will not be pulled from its guide channel.

In applications requiring an overhead door of the present type but not requiring a door that is capable of being open even when a pressure differential exists, the aforementioned plastic strips 43 and 45 are still very useful because of their ability to reduce friction. Thus these strips can be used on doors in above ground locations where a door pressure releasing mechanism such as the hydraulic cylinders 44 are not required.

It will be clear to those skilled in the art that various modifications and changes can be incorporated in the door structure of the present invention. All such modificactions and changes that fall within the scope of the appended claims are intended to be covered by the present application.

What I claim as my invention is:

1. A pressure-differential compensating door assembly, comprising:

a flexible rubber or synthetic rubber curtain for closing a doorway having a first upper end, a second lower end and side edges;

a curtain winding mechanism having said first end of said curtain attached thereto for raising said curtain by rolling said curtain up;

a pair of spaced apart, vertically extending, straight guide channel means, side edge sections of said curtain being movable in a straight path in said guide channel means and sealingly engageable therewith;

an open centered door frame including a horizontally extending upper portion and two, straight vertically extending side portions located at opposite ends of said upper portion, said guide channels being arranged on said vertically extending portions;

means at the bottom end of each of said vertically extending side portions for pivotally connecting said door frame to fixed door surrounding structure; and door pressure releasing means adapted to connect said door frame in sealing engagement with said door surrounding structure, said door pressure releasing means being operable to pivot said door assembly away from said door surrounding structure prior to said curtain being raised and to release any pressure differential existing on opposing sides of said curtain, said releasing means including two power expandable mechanisms each pivotally mounted at and supported by the upper end of said door frame and adapted for connection to the adjacent door surrounding structure.

2. A door according to claim 1 wherein said side edge sections of said curtain can be pulled from said guide channel means under a predetermined impact force.

3. A door according to claim 2 wherein said curtain winding mechanism includes a horizontally extending barrel, said curtain unwinds from said barrel from the side thereof closest to the adjacent door surrounding structure, an upper portion of each guide channel means includes a short guide member hingedly connected to respective lower portion of said guide channel means whereby each said guide member can be pivoted through a substantial angle and about its hinge connection to facilitate insertion of said side edge section of said curtain in said guide channel means.

4. A door according to claim 2 wherein a rigid bar is attached to said second end of said curtain.

5. A door according to claim 1 wherein a rigid bar is attached to said second end of said curtain and can release from said curtain under predetermined impact force with little or no damage to said curtain.

6. A door according to claim 1 wherein each expandable mechanism is a hydraulic mechanism.

7. A door according to claim 1 wherein each power expandable mechanism has a contracted positon which secures the door frame in sealing engagement with the door surrounding structure, and each mechanism is movable to an expanded position to separate the door frame from the door surrounding structure at the upper portion of the door frame with the door frame pivoting about said connecting means and wherein the two power expandable mechanisms are located on opposite sides of said door frame.

8. A door according to claim 7 wherein each power expandable mechanism comprises a cylinder and piston movable in said cylinder.

9. A door according to claim 8 wherein each cylinder is hydraulically actuated.

10. A door according to claim 7 wherein said side edge sections of said curtain can be pulled from said guide channel means under a predetermined impact force.

11. A door according to claim 10 wherein said curtain winding mechanism includes a horizontally extending barrel, said curtain unwinds from said barrel from the side thereof closest to the adjacent door surrounding structure, an upper portion of each guide channel means includes a short guide member hingedly connected to respective lower portion of said guide channel means whereby each said guide member can be pivoted through a substantial angle and about its hinge connection to facilitate insertion of said side edge sections of said curtain in said guide channels.

12. A door according to claim 2 wherein each guide channel means has an inner side located towards said door surrounding structure and an outer side located further from said surrounding structure and the outer side of said guide channel means, which is made of flexible steel, moves outwards under the predetermined impact force to facilitate said side edges of said curtain being pulled therefrom.

13. A door according to claim 8 wherein each guide channel means has an inner side located towards said door surrounding structure and an outer side located further from said surrounding structure and the outer side of said guide channel means, which is made of flexible steel, moves outwards under said predetermined impact force to facilitate said side edges of said curtain being pulled therefrom.

14. A roll-up door comprising:

a flexible rubber or synthetic rubber curtain for closing a doorway having a first upper end, a second lower end, side edges and a generally flat surface on both sides thereof, said curtain having side edge sections that are thicker than the remainder of said curtain and having two sloping shoulders formed between the thinner region of said curtain and said side edge sections;

a curtain winding mechanism having said first end of said curtain attached thereto for raising said curtain;

a pair of spaced apart guide channel means, said side edge sections of said curtain being movable in said guide channel means and engageable therewith; and friction reducing means in the form of numerous, short, ultrahigh molecular weight plastic strips bonded to both of said shoulders and extending therealong to reduce the amount of friction between said shoulders and their respective guide channels, wherein said strips are spaced apart and in an end-to-end relationship.

15. A roll-up door according to claim 14 wherein ultrahigh molecular weight plastic strips are affixed to the back of each side edge section on the side of said curtain opposite said shoulders.

16. A roll-up door according to claim 14 wherein plastic strips are bonded to the back of each side edge section on the side opposite said shoulders and the plastic strips on the back form continuous strips, said continous strips being on the radially outer side of the rolled-up curtain and acting as seals.

17. A roll-up door according to claim 14 wherein a continuous plastic strip is provided on the side of said curtain opposite said sloping shoulders along each side edge section.

18. A roll-up door assembly adapted to operate when differences in pressure exist between opposite sides of the door assembly, said door assembly comprising:

a flexible rubber or synthetic rubber curtain for closing a doorway having an upper end, a lower end, side edges and a generally flat surface on both sides thereof;

a curtain winding mechanism having said upper end of said curtain attached thereto for raising said curtain by rolling said curtain up;

a movable, open centered door frame including an upper, horizontally-extending portion and two vertically-extending side portions;

a pair of elongate, vertically extending, straight guide channel means, each connected to a respective one of said side portions of said door frame, side edge sections of said curtain being movable in a straight path in said guide channel means and sealingly engageable therewith;

means at the bottom end of each of said vertically-extending side portions for pivotally connecting said door frame to fixed door surrounding structure;

friction reducing means in the form of plastic strips bonded to both of said side edge sections and extending therealong to reduce the amount of friction between said side edge sections and their respective guide channels; and door pressure releasing means adapted to connect said door frame in sealing engagement with a door surrounding structure, said releasing means being operable to pivot said door assembly away from said door surrounding structure prior to said curtain being raised and to release any pressure differential existing on opposing sides of said door assembly, said releasing means being two power expandable mechanisms each pivotally mounted at and supported by the upper end of said door frame and operatively connected to the adjacent door surrounding structure.

19. A roll-up door according to claim 18 wherein said expandable mechanisms comprise two hydraulic cylinder-piston mechanisms, aid mechanisms being connected to opposite sides of said door frame.

20. A roll-up door according to claim 19 wherein said curtain winding mechanism is mounted on said horizontally-extending portion of said door frame.

21. A roll-up door according to claim 18 wherein said plastic strips are constructed with ultrahigh molecular weight plastic and are affixed to both the front and back of each side edge section.

* * * * *